United States Patent [19]

Fischer

[11] 4,131,198

[45] Dec. 26, 1978

[54] LIGHT BULB PACKAGE

[75] Inventor: Edward F. Fischer, Dumont, N.J.

[73] Assignee: Federal Paper Board Co., Inc., Montvale, N.J.

[21] Appl. No.: 835,152

[22] Filed: Sep. 21, 1977

[51] Int. Cl.[2] ..... B65D 85/42

[52] U.S. Cl. ..... 206/419; 206/45.19; 206/486; 206/589; 229/22; 229/39 B; 229/27

[58] Field of Search ..... 229/22, 39 B, 40, 27; 206/45.14, 45.19, 196, 199, 329, 341, 419, 420, 421, 418, 435, 434, 476, 486, 488, 562, 563, 589

[56] References Cited

U.S. PATENT DOCUMENTS

| | | | |
|---|---|---|---|
| 2,368,753 | 2/1945 | Elliott et al. | 206/419 |
| 2,421,748 | 6/1947 | Fink | 229/39 B |
| 2,682,949 | 7/1954 | Whitehead | 229/39 B |
| 2,781,898 | 2/1957 | Desmond et al. | 206/45.19 |
| 2,784,839 | 3/1957 | Omer, Jr. | 206/419 |
| 2,851,158 | 9/1958 | Gish et al. | 206/45.19 |
| 2,869,720 | 1/1959 | Mahoney | 229/39 B |
| 2,939,622 | 6/1960 | D'Ippolito | 229/39 B |
| 3,282,410 | 11/1966 | Cote | 229/39 B |
| 3,598,302 | 8/1971 | Nowak | 229/40 |
| 3,854,580 | 12/1974 | Hennessey | 229/40 |
| 4,037,717 | 7/1977 | Roccaforte | 206/45.14 |

*Primary Examiner*—William Price
*Assistant Examiner*—Bruce H. Bernstein
*Attorney, Agent, or Firm*—Guy A. Greenawalt

[57] ABSTRACT

A package which is adapted for marketing a pair of electric light bulbs as a unit and which is formed from a single blank of foldable sheet material and is characterized by panel portions of the blank being folded and secured in tube formation about the bulbs which are in side-by-side relation and with other panel portions arranged to provide top and bottom end receiving pocket structures which hold the bulbs in spaced, side-by-side position within the tube, the sidewall panels being in planes which are in slanted relation between the top and bottom wall panels.

7 Claims, 7 Drawing Figures

55'
56'
50'
54'
14'
57'
48'
46'
52'
53'
47'
26'
44'
38'
73'
74'
65'
68'
70'
72'
75'
66'
16'
64'
62'
78'
67'
80'
76'
63'
77'
12
10
60'
40'
a
a
18
20
22
24
36
28
30
32
34
38
40
42
44
47
26
76
60
77
63
78
80
52
46
67
64
68
62
66
16
57
75
48
14
70
65
72
53
54
50
56
74
73
55
68'
72'
62'
66'

46'
57'
47'
26'
64'
75'
48'
70'
65'
36
50'
74'
73'
a
55'
55
a a
a
36
46
55
73
75
57
26
62

LIGHT BULB PACKAGE

BACKGROUND OF THE INVENTION

This invention relates to packaging and is more particularly concerned with improvements in the packaging of products having a general configuration corresponding to that of an electric light bulb.

Numerous packaging designs have been proposed for enclosing products which are relatively fragile, such as, electric light bulbs, in a wrapper, or carton, so as to enable the package to be handled with minimum risk of damage to the product. Because of the fragile nature of the product, the packaging material employed has most often been corrugated paperboard or a cushioning material of a type designed to reduce breakage of the glass bulb. While some designs have been developed which may employ conventional paperboard stock for the wrapper or carton, these have generally not proven acceptable because they do not afford sufficient protection against breakage or other damage to the product or because of problems arising in forming the package on mechanized equipment which is readily available, or convertible, for handling the wrapper material and the product.

It is a general object of the present invention to provide a package for light bulbs or similar products which may be formed by enclosing the product in a carton or wrapper of paperboard or similar foldable sheet material which is cut, scored and formed, with a minimum of adhesive, into a container for the product so as to provide satisfactory protection against breakage during normal handling of the package, and also to provide a neat and attractive package for marketing the product.

A more specific object of the invention is to provide a packaging arrangement for light bulbs, or similar articles, wherein a blank of paperboard, or similar foldable sheet material, is cut and scored for assembly into a container for a pair of the articles which are arranged in side-by-side relation and held in the encircling container in non-engaging relation by seating them at their opposite ends in apertured portions of the blank which are secured adjacent top and bottom walls of the container in inwardly spaced relation thereto and proportioned so as to provide the container formed by the encircling walls with a truncated cone shape in transverse section and with the sidewalls in planes which follow generally the contour of the articles and which are spaced from the confronting surfaces of the articles.

To this end the container and package which are disclosed and claimed herein comprises top and bottom wall members and connecting sidewall members which join the side edges of the top and bottom wall members, with sidewall members disposed in angularly related planes whereby a tubular container is formed with generally triangular cross sectional configuration and with article retaining means in the form of apertured panels hinged inwardly from the opposite end edges of the top and bottom wall members and secured in spaced relation to the same so as to form article holding and retaining structures having pockets in which the top and bottom ends of a pair of articles of generally bulbous shape are adapted to be seated.

The foregoing and other objects and advantages of the invention will be more readily understood when reference is had to the electric light bulb package which is herein described and the preferred form of which is shown by way of example in the accompanying drawings wherein:

DESCRIPTION OF THE PREFERRED EMBODIMENTS OF THE INVENTION

Figure 1:
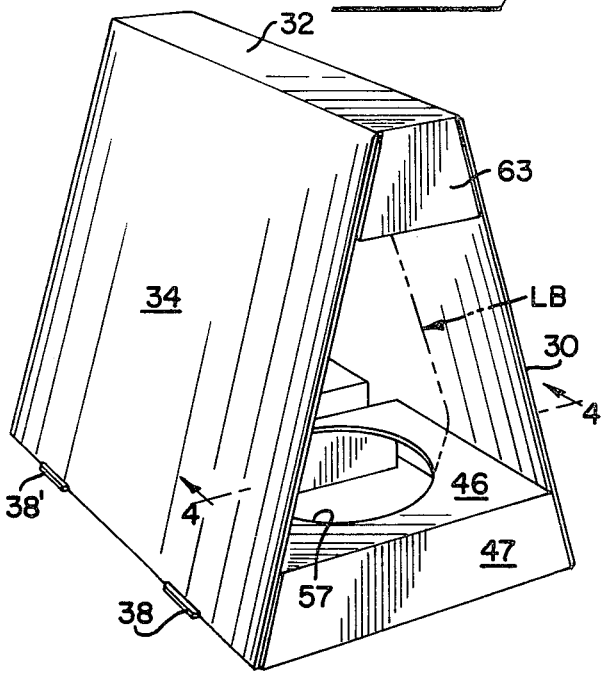
FIG. 1 is a perspective view of a package of light bulbs which incorporates therein the principle features of the invention, with portions of a bulb at the exposed end of the package being shown in phantom line.
Figure 2:
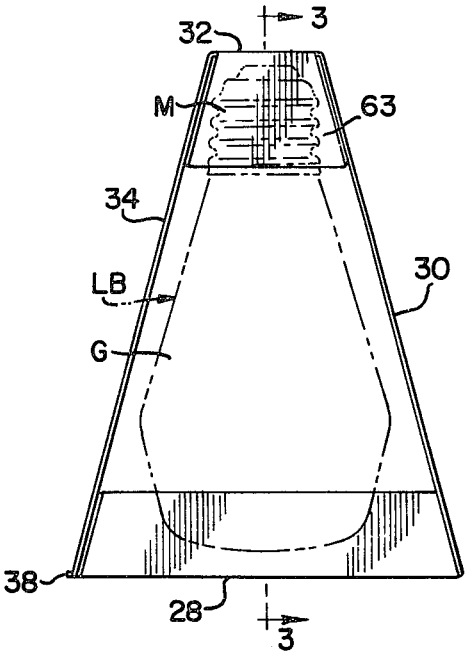
FIG. 2 is an end elevational view of the package of FIG. 1.
Figure 3:
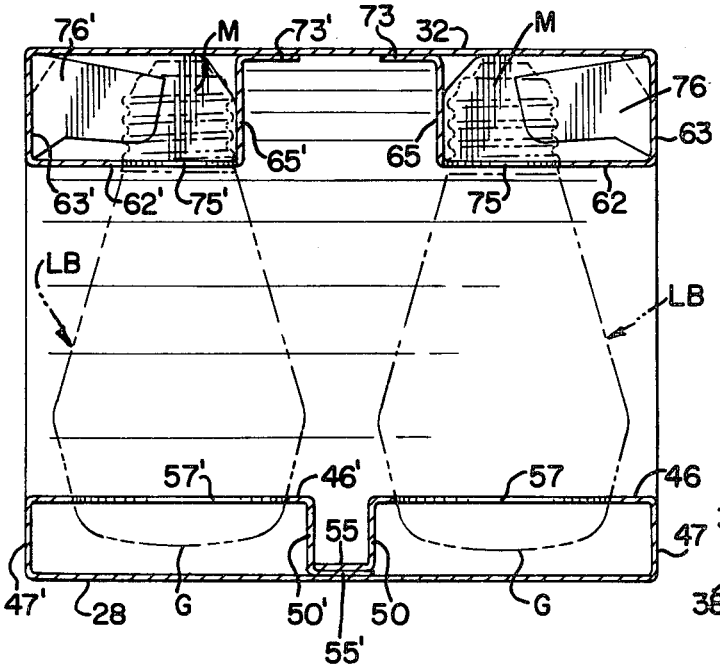
FIG. 3 is a cross sectional view of the package of FIG. 1, the view being taken on the line 3—3 of FIG. 2 with a pair of light bulbs shown in phantom line.
Figure 4:
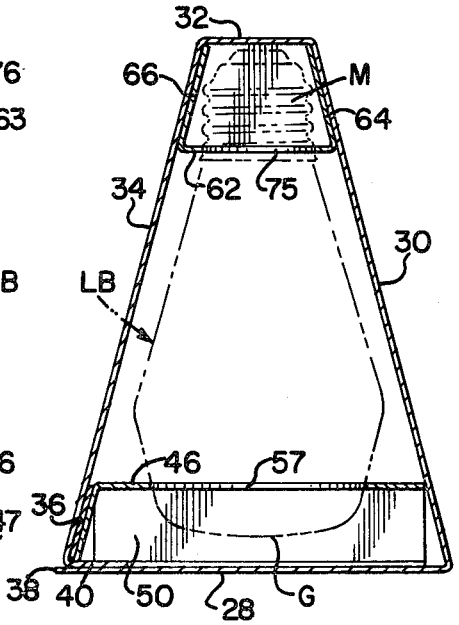
FIG. 4 is a cross sectional view of the package of FIG. 1, the view being taken on the line 4—4 of FIG. 1 with a light bulb shown in phantom line.
Figures 5, 6, 7:
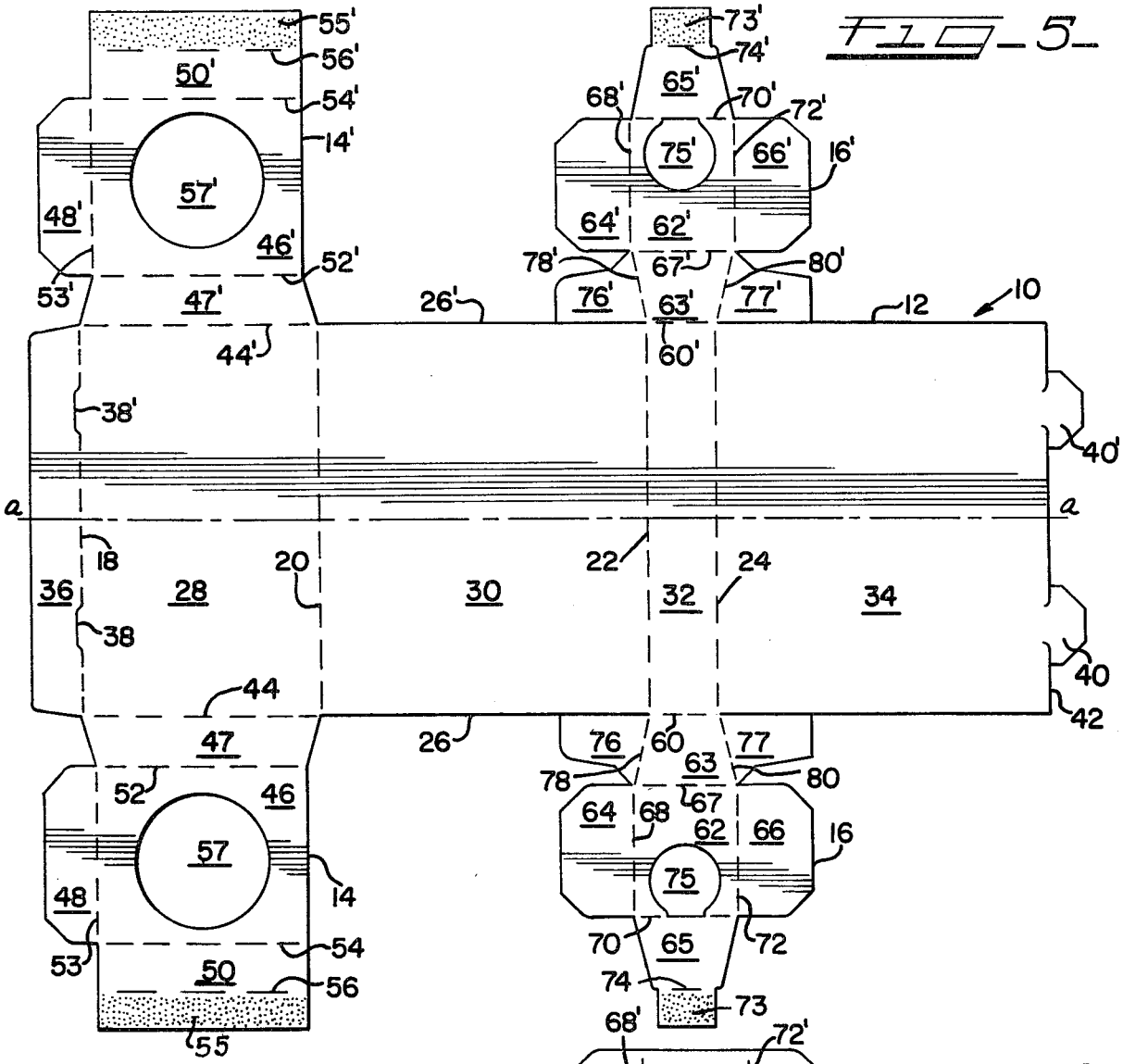
FIG. 5 is a plan view showing the inside face of a paperboard blank which is cut and scored for fabricating the package of FIG. 1.
FIG. 6 is a partial plan view of the blank of FIG. 5 with portions thereof initially folded and secured preparatory to wrapping the blank about a pair of light bulbs.
FIG. 7 is a partial plan view of the blank with the apertured bulb retaining panels moved into erected position for receiving the ends of the bulbs.

Referring first to FIG. 5, the blank 10, which may be paperboard of relatively light gauge, or similar foldable sheet material, is cut and scored as shown, so as to provide a main body or main wall panel forming section 12 of generally rectangular shape and laterally extending pairs of pocket forming panel sections 14, 14' and 16, 16' which are spaced longitudinally of the blank section 12 and extending laterally from the side edges of the section 12, the entire blank being cut and scored so as to be symmetrically about a longitudinal center line a—a.

The blank section 12 is divided by longitudinally spaced transverse hinge forming score or crease lines 18, 20, 22 and 24, which extend between partially scored, partially cut lines defining the side edges 26, 26' of the section 12, into a series of connected panels including a base or bottom wall forming panel 28, at the one end of blank section 12, a relatively wide side wall forming panel 30 extending from one side of the panel 28, a narrow top wall forming panel 32 adjoining the same and another side wall forming panel 34 at the end of blank section 12 which adjoins the top wall panel 32. A narrow panel forming a tucking tongue or strip 36, which extends along the end margin, is separated by the transverse score line 18 from the base panel 28 and a pair of transversely spaced locking slits 38, 38' are cut in the score line 18 for cooperation with transversely spaced locking tongue members 40, 40' which extend from the opposite end edge 42 of the blank. The locking tongues 40, 40' and cooperating slits 38, 38' are of well known construction and are interengaged in a well known manner to connect the panels when the blank is wrapped about a pair of light bulbs B in forming the tubular package shown in FIGS. 1 to 4.

The blank sections 14, 14', which are adapted to form the retaining pockets for the light emitting, larger end portions of the glass bulb elements G of the light bulbs LB (FIGS. 1 to 4), extend laterally of the opposite edges 26, 26' of the one end of the main blank section 12 and are separated from the bottom wall forming panel 28 by scored portions 44, 44' of the edge lines 26, 26'. These panels are each divided in an identical manner into an apertured main support panels 46, 46' of rectangular configuration and narrow edge panels 47, 48, 50 and 47', 48', 50' which extend along three sides thereof and which are separated therefrom by hinge score lines 52, 53, 54 and 52', 53, 54', with the panels 50, 50' on the outermost edges having integral glue flaps 55, 55' separated therefrom by hinge score lines 56, 56'. The main support panels 46, 46' have a dimension in the direction transversely of the blank which is somewhat less than one half the width of the blank section 12 and a slightly greater dimension in the direction of the length of blank section 12 but less than the distance between the transverse score lines 18 and 20 in the form shown. The panels 46, 46' each have a circular opening 56, 56' cut therein with the centers thereof approximately in a transverse line bisecting the panel 28. The diameter of each opening 56, 56' is such that the glass end of the bulb will seat therein and not extend more than a small, predetermined distance beyond the plane of the apertured panel. The panels 47, 47' extend between the score lines 44, 52 and 44', 52' and have a dimension transversely of the blank section 12 which is appreciably greater than the distance the bulbs will project through the pocket defining apertures or openings 57, 57'. The other two edge panels 48, 50 and 48', 50' are substantially the same width as the panels 47, 47', and the glue flaps 55, 55' on the outermost edges are of slightly lesser width than the adjoining panels 50, 50'.

The blank sections 16, 16', which are adapted to provide pockets constituting supporting and retaining means for the base or power contact ends of the light bulbs, extend laterally of the opposite edges 26, 26' of the main blank section 12 on a line with the top wall forming panel 32. The lateral dimension of each of these panel forming sections 16, 16' is approximately the same as the corresponding dimension of the blank sections 14, 14', in the illustrated arrangement. The sections 16, 16', which are subdivided to provide a pocket forming supporting panel structure for the base portions of the light bulbs, are separated from the blank section 12 by hinge forming score line portions 60, 60' of the side edge formations 26, 26' of the blank section 12, which score line portions 60, 60' define the opposite end edges of the top wall forming panel 32. The blank sections 16, 16' are cut and scored in an identical manner so that the resultant panels are in an arrangement which is symmetrical about a transverse line bisecting the panel 32. The section 16, 16' are divided into apertured main support panels 62 62' of rectangular configuration and edge panels 63, 64, 65, 66 and 63', 64', 65', 66' which extend along the four sides or edges of panels 62, 62' and are separated therefrom by hinge forming score lines 67, 68, 70, 72 and 67', 68', 70', 72' with the panels 65, 65' on the outer edges having integral glue flaps 73, 73' divided therefrom by hinge score lines 74, 74'. The rectangular panels 62, 62' have a dimension in the direction transversely of the blank which is somewhat less than one half of the width of the blank section 12 and a dimension in the direction of the length of the blank which is somewhat greater than the corresponding dimension of the bottom wall forming panel 32. Generally circular apertures 75, 75' are cut in the panels 62, 62' which have their centers located approximately on a transverse line bisecting the panel 32. The apertures 75, 75' are of a size to receive the screw threaded base or mounting members M of the light bulbs LB and are located adjacent the outboard hinge scores 72, 72' in predetermined spaced relation to the opposite hinge scores 67, 67'. The inboard and outboard edge panels 63, 63' and 65, 65' have a width, that is, a dimension in the direction transverse of the blank, which is determined by the dimension of the light bulb mounting members M in the axial direction so that the members M may be seated in the apertures with the terminal ends in spaced relation relative to the wall panel 32 when the package is in the final form shown in FIGS. 1 to 4. The edge panels 64, 64' and 66, 66' have approximately the same width as the panels 63, 63' and 65, 65', that is, the same dimension in the direction lengthwise of the blank. The panels 63, 63' have foldable wing tabs 76, 77 and 76', 77' extending in the direction lengthwise of the blank section 12 and separated from the associated edge panels 63, 63' by score lines 78, 80 and 78', 80' which extend between corresponding ends of the score lines 60, 67 and 60', 67' and cooperate with the latter in defining the truncated triangular shaped end wall panels 63, 63'.

Preparatory to the packaging operations, the pocket forming panel assemblies are folded and secured in the position shown in FIG. 6. An adhesive is first applied to glue panels or glue tabs 55, 55' and 73, 73' and the extending panel forming sections 14, 14' are folded on the hinge lines 52, 52' which the sections 16, 16' are folded on the hinge lines 67, 67', respectively which positions the sections 14, 14' and 16, 16', as indicated in FIG. 6, in flattened relation on opposite sides of the main section 12 of the blank with the glue tabs 55, 55' secured in overlying relation on the panel 28 of the blank along the longitudinal center line a—a and with the glue tabs 73, 73' secured to the inside face of the top wall forming panel 32 and spaced on opposite sides of the centerline a—a. The blank forming operation is then completed and ready for the bulb enclosing operation.

In setting up the blank and folding it about the pair of bulbs LB the socket forming panel assemblies are erected so as to receive the end portions of the bulbs prior to or during the folding of the top, bottom and sidewall panels about the bulbs. The apertured panels 46, 46' are hinged into the position indicated in FIG. 7 about the hinge lines 44, 47, 54, 56 and 44', 47', 54', 56' and the edge panels 48, 48' are hinged on the lines 53, 53' into a plane parallel with the plane of the sidewall panel 34 when it is in the position shown in FIG. 4 with its margin overlying the tuck panel 36. The outboard glue panels 55, 55' which are secured to each other and to the bottom wall panel 28 on the longitudinal center line a—a space the bulb pocket assemblies so that when the glass ends of the bulbs are seated in the apertures 57, 57' the bulbs are out of contact. The pocket forming panel assemblies 16, 16' are erected by movement on the hinge lines 60, 67, 70, 74 so as to bring the apertured panels into planes spaced below the top wall panel 32. The wing tabs 76, 77 and 76', 77' are folded inwardly toward each other about the hinge lines 78, 80 and 78', 80' with the edge panels 64, 66 folded inwardly into planes parallel with the slanted sidewall panels 30, 34. The panels 62, 62' are positioned with the socket forming apertures 75, 75' aligned vertically with the apertures 57, 57' so as to receive the mounting members M of the bulbs and cooperate with the bottom socket formations in holding the bulbs in vertical position and out of contact with each other. The main panels 28, 30, 32 and 34 are, of course, folded about the hinge lines 20, 22 and 24, with the tuck panel 36 folded about the hinge line 18 and the locking tabs 40, 40' are engaged in the cooperating locking apertures so as to contain the bulbs in the tubular package thus formed. The panels are proportioned so as to form an open ended package (FIGS. 1 to 4) with the bulbs spaced from each other and from the sidewalls as well as from the top and bottom walls so as to afford protection against damage under ordinary handling and permitting stacking and multiple unit packing with maximum space economy and minimum risk of breakage.

In the form of the blank illustrated, the blank sections 16, 16' extend laterally or outboard of the edges 26, 26' approximately the same distance as the blank sections 14, 14', with overall dimensions of each of the sections 16, 16' and 14, 14' in the longitudinal direction of the blank being approximately the same. The blank sections 14, 14' are positioned opposite each other adjacent the one end of the blank and the sections 16, 16' are spaced from the sections 14, 14' a distance in the direction of the length of the blank corresponding to the dimension of the sections 14, 14' and 16, 16' in the same direction. The distance between the blank sections 16, 16' and the opposite end of the blank corresponds to the dimension of the sections 14, 14' in the longitudinal or lengthwise direction of the blank. The arrangement enables nesting of these sections in reverse relation for cutting from a blank or web with economy of material and minimum waste. That is, two carton blanks may be cut from a rectangular sheet area with the section 14 of one blank and the section 14' of the other blank at opposite ends and aligned in the longitudinal direction and with the two sections 16, 16' of the two blanks cut in side-by-side and longitudinally aligned relation in the area between the sections 14 and 14'. With this arrangement a number of blanks may be cut in nested relation across the width of a web with minimum waste and with maximum economy in the use of the material.

I claim:

1. A package comprising a pair of electric light bulbs disposed in row alignment and enclosed in an open ended tubular container which container is formed from a single blank of paperboard or similar foldable sheet material divided by hinge score lines into a series of hingedly connected panels including top, bottom and sidewall panels, said sidewall panels extending between outer side edges of said top and bottom wall panels in spaced diverging relation from the top panel to the bottom panel so as to provide a tube formation with truncated cone cross section, means for retaining the bulbs in row alignment and in spaced relation within said container which bulb retaining means is in the form of apertured panels disposed in planes which are generally parallel with and spaced from the top and bottom wall panels, said apertured panels extending between the inner faces of said sidewall panels in paired relation at the top and bottom of each end of said container which cooperate in providing pocket formations at each end of said container in which opposite ends of said bulbs are seated, said apertured panels being held in spaced relation relative to said top and bottom wall panels by narrow, integral hinged side edge panels which are disposed in face contacting relation with portions of said sidewall panels and in edge engagement with adjacent top and bottom wall panels, each of said apertured panels of each pair thereof at each of the container ends extending inwardly from the associated open end of said container to a narrow hinge panel which is secured to the confronting wall panel in hinged relation by a glue tab on the edge of said hinge panel.

2. A package as set forth in claim 1 wherein said pocket formations which are provided by said apertured panels comprise apertures in said panels formed of a size and configuration to seat therein end portions of said lamp bulbs so as to confine the same against lateral movement and said panels at the side edges of said apertured panels, being dimensioned so as to hold the ends of the lamp bulbs in spaced relation with the confronting wall surfaces.

3. A carton for packaging a pair of electric light bulbs, or like articles, having the general shape of light bulbs, which is formed from a cut and scored blank of paperboard or similar foldable sheet material, said carton comprising, when set up, integrally hinged generally rectangular top and bottom wall forming panels and sidewall forming panels which are disposed in oppositely inclined planes and connected to said top and bottom wall panels so as to form an open ended tube of truncated cone cross sectional configuration for enclosing the articles in row arrangement therein, and a pair of pocket forming panel arrangements adjacent each of the opposite ends of said carton which are provided for seating therein opposite ends of each of said pair of articles, said pocket forming panel arrangements each comprising an apertured panel defining a pocket for receiving a predetermined end of an article and a hinge panel connecting the outermost edge of said apertured panel with the corresponding edge of the associated wall panel so as to position said apertured panel at a distance from said associated wall panel which is sufficient to hold the end of an article, when seated therein, in spaced relation to the associated wall panel, each said apertured panel having a panel hinged to its innermost edge which is secured to the associated wall panel at a point intermediate the open ends of said carton and which has a dimension in a direction normal to said associated wall panel which corresponds substantially to the corresponding dimension of the hinge panel connecting said apertured panel to the outboard edge of the associated wall panel so as to position said apertured panel in a plane generally parallel with and spaced from the plane of said associated wall panel, and each said apertured panel having at least one additional hinged panel extending along an edge thereof which is disposed so as to lie along the inside face of a sidewall of the carton at the hinge junction of said sidewall with an associated wall.

4. A carton forming blank for packaging a pair of articles in the form of light bulbs comprising a sheet of paperboard or similar foldable sheet material which is cut and scored to provide an elongate generally rectangular main wall forming section which is divided by longitudinally spaced transverse score lines extending between partially scored and partially cut parallel side edge lines into a pair of sidewall forming panels of like dimensions extending on opposite sides of a relatively narrow top wall forming panel, a bottom wall forming panel extending from the one sidewall panel in the direction longitudinally of said wall forming section, and a narrow tuck panel extending along the free end margin of said wall forming section and having at least one locking slit located at the hinge line with the bottom wall forming panel, said other sidewall forming panel having a locking tab on the free edge thereof which is engaged in said locking slit with said tuck panel lying against the inner face of the margin of said sidewall forming panel when the carton is set up, article retaining panel assemblies extending laterally of each of said side edge lines and aligned in the direction laterally of the blank with the top and bottom wall forming panels, each of said article retaining panel assemblies being integral with the associated top and bottom wall forming panels and each including a panel having a pocket forming aperture therein which is separated from its associated wall panel by a narrow hinge strip and which has on its free margin a hinge strip of like dimension in the direction transversely of the blank, with a glue tab forming panel at its outermost edge enabling each article retaining panel assembly to be hinged into overlying and flattened relation with the associated wall panel and the glue tab to be secured to the associated wall panel prior to wrapping the blank about a pair of said articles, so as to cooperate in forming a pair of pockets at each end of the carton when it is set up for receiving therein the opposite ends of one of said pair of articles.

5. A carton forming blank as set forth in claim 4 wherein each of said article retaining panel assemblies includes at least one further edge panel extending laterally of the blank and along a transverse edge of said apertured panel and having a dimension in the direction longitudinally of the blank which corresponds substantially to the transverse dimension of said hinge strip which extends between said apertured panel and the side edge line of said main wall forming section of said blank.

6. A carton forming blank as set forth in claim 4 wherein said bottom wall forming panel has a dimension in the direction longitudinally of the main wall forming section of the blank which is substantially greater than the corresponding dimension of said top wall forming panel, and wherein said apertured panels extending from the top wall forming panel have a dimension in the direction longitudinally of the blank which is slightly greater than the corresponding dimension of the top wall forming panel and the apertured panels extending from the bottom wall panel have a dimension in the direction longitudinally of the blank which is slightly smaller than the corresponding dimension of the bottom wall forming panel.

7. A carton forming blank as set forth in claim 4 wherein said panel assemblies extend laterally of the main wall forming section approximately the same distance and said assemblies each having approximately the same overall dimension in the longitudinal direction of the blank with corresponding assemblies disposed at one end of the blank and the associated assemblies aligned therewith in the longitudinal direction and spaced therefrom a distance corresponding to the dimension thereof in said longitudinal direction so as to provide when the carton is set up partial openings in opposite ends of the carton and to enable cutting the blank forming sheets from a wide blank or web with said panel assemblies along one edge of each blank in longitudinally aligned and nested relation with the panel assemblies along the opposite edge of another blank.

* * * * *